US008186196B2

(12) United States Patent
Schlatter

(10) Patent No.: US 8,186,196 B2
(45) Date of Patent: May 29, 2012

(54) METHOD AND DEVICE FOR LUBRICATING TOOL AND WORKPIECE AT CUTTING

(75) Inventor: Ulrich Schlatter, Lyss (CH)

(73) Assignee: Feintool Intellectual Property AG, Lyss (CH)

( * ) Notice: Subject to any disclaimer, the term of this patent is extended or adjusted under 35 U.S.C. 154(b) by 799 days.

(21) Appl. No.: 12/283,686

(22) Filed: Sep. 15, 2008

(65) Prior Publication Data

US 2009/0103995 A1 Apr. 23, 2009

(30) Foreign Application Priority Data

Sep. 14, 2007 (EP) ..... 07018133

(51) Int. Cl.
*B21B 45/02* (2006.01)

(52) U.S. Cl. ..... 72/43

(58) Field of Classification Search ..... 72/39–45; 83/22; 409/136
See application file for complete search history.

(56) References Cited

U.S. PATENT DOCUMENTS

| | | | | |
|---|---|---|---|---|
| 2,821,156 | A * | 1/1958 | Lyon | 72/43 |
| 3,554,065 | A | 1/1971 | Kunz | |

FOREIGN PATENT DOCUMENTS

| | | |
|---|---|---|
| DE | 1 752 239 | 8/1971 |
| EP | 1 707 285 | 10/2006 |
| JP | 57-001527 | 1/1982 |
| JP | 3-268808 | 11/1991 |
| JP | 4-294831 | 10/1992 |
| JP | 2007-007692 | 1/2007 |
| JP | 2007-029992 | 2/2007 |
| WO | WO-02/38695 | 5/2002 |

* cited by examiner

*Primary Examiner* — Teresa Ekiert
(74) *Attorney, Agent, or Firm* — Jordan and Hamburg LLP

(57) ABSTRACT

A method and device for lubricating tool and workpiece at cutting and forming, especially fine blanking of a workpiece with 5 mm or more thickness and with complex part geometry from a flat strip lubricates a tool and workpiece at cutting and forming, so that fine blanking of thicker parts is reproducible, with high quality. Extended the edge life of the tools is achieved by lubricating the active surfaces without the provided lubricating film breaking off. One quantity of cutting oil is accumulated in a micro-surface structure of a functional surface of shearing punch and cutting die and evenly distributed on the functional surfaces as quasi-stationary cutting oil film by cooperation of functional surfaces moving past each other when the tool is closed, and another quantity of accumulated cutting oil, via the respective effective gaps, is provided to the active surfaces of shearing punch and workpiece in the forming zone.

24 Claims, 15 Drawing Sheets

STATE OF THE ART

STATE OF THE ART

METHOD AND DEVICE FOR LUBRICATING TOOL AND WORKPIECE AT CUTTING

BACKGROUND OF THE INVENTION

The invention relates to a method for lubricating a tool and a workpiece at cutting and forming, especially fine blanking of a workpiece with a thickness of 5 mm or more and with complex part geometry from a flat strip, wherein the flat strip, wetted on the surface with a lubricating oil film of sufficient thickness at closing, is clamped between an upper part consisting of a shearing punch, a pressure pad for the shearing punch, a V-shaped projection positioned on the pressure pad and an ejector and a lower part consisting of cutting die, ejector and a inner form punch, and the lubricating oil by the pressure pad, the shearing punch, the ejector, the cutting die, the ejector and the inner form punch is pressed out and forced into chamfers at the pressure pad and the ejectors forming lubrication bore reliefs in which it is temporarily stocked up.

The invention further relates to a method for lubricating a tool and a workpiece at cutting and forming, especially fine blanking of a workpiece with a thickness of 5 mm or more and with complex part geometry from a flat strip, wherein the flat strip, wetted on the surface with a lubricating oil film of sufficient thickness at closing, is clamped between an upper part consisting of a shearing punch, a pressure pad for the shearing punch, a V-shaped projection positioned on the pressure pad and an ejector and a lower part consisting of cutting die, ejector and a inner form punch, wherein the effective gaps between shearing punch and pressure pad, cutting die and ejector as well as shearing punch and inner form punch are supplied with cutting oil.

The invention further relates to a method for lubricating a tool and a workpiece at cutting and forming, especially fine blanking of a workpiece with a thickness of 5 mm or more and with complex part geometry from a flat strip with a tool consisting of two parts with at least one shearing punch, one pressure pad for the shearing punch, one positioned on the pressure pad V-shaped projection, one ejector, one cutting die, one ejector and an inner form punch, wherein the flat strip, wetted on both sides with a lubricating oil film of sufficient thickness, is clamped between pressure pad and cutting die and the lubricating oil on the upper side of the workpiece is collected in chamfers positioned at the pressure pad and the ejector and on the bottom side in chamfers at the cutting die and the ejector forming lubrication bore reliefs, wherein effective gaps between shearing punch and pressure pad, cutting die and ejector and shearing punch and inner form punch are provided to supply the cutting oil.

The invention further relates to a method for lubricating a tool and a workpiece at cutting and forming, especially fine blanking of a workpiece with a thickness of 5 mm or more and with complex part geometry from a flat strip, with a tool consisting of two parts with at least one shearing punch, one pressure pad for the shearing punch, one positioned on the pressure pad V-shaped projection, one ejector, one cutting die, one ejector and an inner form punch, wherein the flat strip, wetted on both sides with a lubricating oil film of sufficient thickness, is clamped between pressure pad and cutting die and effective gaps between shearing punch and pressure pad, cutting die and ejector and shearing punch and inner form punch are provided to supply the cutting oil.

It is known that fine blanking, because of the high wear associated therewith, cannot be realized without lubricating oil. Fine blanking without lubricating oil, especially in case of thicker parts, already after a few strokes, leads to bonding between the shearing punch and the material of the workpieces. In addition, in the case of thinner parts, bluntness of the tool occurs rapidly.

As known from "Umformen and Feinschneiden—Handbuch für Verfahren, Stahlwerkstoffe, Teilegestaltung" (R. A. Schmidt, Carl-Hanser-Verlag 2007, Munich, Vienna, p. 241-243) the wear stress of the shearing punch, the cutting die, the V-shaped projection and the inner form punch in the fine blanking tool reaches a serious degree, and the tendency towards cold bondings between punch and workpiece grows significantly, especially in the case of a workpiece thickness of more than 10 mm.

To oppose wear and cold bonding, this state of the art proposes to provide the workpiece or the strip, on the upper and lower sides thereof, with an oil film of sufficient thickness. The lubricated strip is pushed into the open tool and clamped between the upper and the lower parts of the tool when it closes. The oil on the upper and lower sides of the strip, on the one hand, is pressed out by the pressure pad, the shearing punch and the ejector of the cutting tool and, on the other hand, by the cutting plate, the ejector and the inner form punch and forced into lubrication bore reliefs, on the upper side of the strip formed by chamfers at the pressure pad and the ejector and on the bottom side by a chamfer at the ejector.

Despite all theses measures, it remained heretofore a problem to provide a sufficient quantity of lubricating oil to the forming zone, so as to allow fine blanking of parts thicker than 10 mm and with complex part geometry.

From DE 1 752 239 it is further known to apply a die-plate of porous hard metal. Lubricating material deposits in the pores of the die-plate contributes to the lubricating film not breaking off during cutting. However, this known solution cannot insure that the lubricant can reach the forming zone.

At this state of the art, it is an object of the invention to further develop a method and a device for lubricating a tool and a workpiece at cutting and forming, especially at fine blanking of a workpiece, so that fine blanking of thicker parts is reproducible, controlled process secure, with high quality and at the same time, extended edge life of the tools is achieved by lubricating the active surfaces up to the forming zone without the provided lubricating film breaking off.

SUMMARY OF THE INVENTION

This object is realized by a method of the kind mentioned above, in which a quantity of cutting oil from the stocked up cutting oil is accumulated in a micro-surface structure of each of respective functional surfaces of a shearing punch and a cutting die and a quasi-stationary cutting oil film is evenly distributed on the functional surfaces moving past each when the tool is closed.

In accordance with the solution according to this invention, from the stocked up cutting oil, a first partial quantity is accumulated in a micro-surface structure of a functional surface of shearing punch and cutting die and evenly distributed on the functional surfaces as quasi-stationary cutting oil film by cooperation of functional surfaces moving past each other when the tool is closed, and that a second partial quantity of cutting oil, via the respective effective gaps, is provided to the active surfaces of the shearing punch and workpiece in the forming zone.

The lubrication of the active surfaces of the shearing punch or the inner form punch and workpiece further can be enhanced by permanently providing an additional quantity of fine blanking oil under controllable pressure to the effective gaps via a conduit extending in the shearing punch, the ejector and the inner form punch, of which a first partial quantity is accumulated in a micro-surface structure of a functional surface of shearing punch and cutting die, and evenly distributed on the functional surfaces of shearing punch and pressure pad, ejector and cutting die and ejector and inner form punch as quasi-stationary cutting oil film by cooperation of the functional surfaces moving past each other when the tool is closed, and that a second partial quantity of cutting oil via the respective effective gap is provided to the active surfaces of the shearing punch and workpiece in the forming zone.

Depending on workpiece thickness, geometry and material of the parts to be fine blanked, the size or dimensions of the chamfers at the pressure pad and the ejectors or the pressure for providing the cutting oil are selected so that a sufficient quantity of cutting oil is provided in the lubrication bore reliefs or at the outlet openings. In other words, the quantity of cutting oil, with rising workpiece thickness, has to respectively rise, and the chamfers or the oil pressure have to be chosen with larger values, respectively.

The quantity of oil provided from the lubrication bore reliefs to the forming zone is determined by the quantity of oil that can be accumulated in the micro-surface structure, which depends on the geometry, shape and depth of the micro-surface structure of the functional surfaces. In order to bring a sufficient quantity of lubricating oil to the forming zone, the oil accumulation volume of the micro-surface structure is respectively adjusted to the workpiece thickness, material and geometry.

The micro-surface structure of the functional surfaces of the shearing punch and inner form punch, as well as of cutting die and ejector, consists of indentations and/or pits and/or bore holes in the μm-range, produced by precise laser beam machining without finishing or grinding or milling. These indentations and/or pits and/or bore holes fill up with cutting oil that stays there because of the functional surfaces passing each other and being subjected to the high temperatures caused at the friction places, so that a lubricating film can develop.

The method according to this invention makes it possible to economically apply fine blanking also to workpieces or strips of steel or aluminum thicker than 5 mm, and to reach a high process security and reproducible precision at the production of the parts.

The functional surfaces, i.e., the surface areas of shearing punch and inner form punch, as well as the guide surfaces of the cutting die and ejector, have indentations and/or pits and/or bore holes of nearly identical geometry, shape and depth, so that it can be secured that the oil accumulated in the indentations and/or pits and/or bore holes is not removed during cutting. The quantity of fine blanking oil provided above, is transported to the forming zone.

Resulting from this, the forming zone is provided with a sufficient quantity of fine blanking oil with additives, so that the tendency towards cold bondings at the active surfaces between shearing punch and workpiece is significantly reduced and the wear of the fine blanking tools can be significantly reduced, bringing along the advantage of a significantly longer edge life of the tools.

The indentations and/or pits and/or bore holes cover the functional surfaces in a regular arrangement, which is formed of rows of indentations and/or pits and/or bore holes, one above or beneath the other horizontally arranged and not connected to each other, wherein the indentations and/or pits and/or bore holes of opposite rows are arranged in a staggered manner to each other, so that an extremely dense regular covering of the functional surfaces with the indentations and/or pits and/or bore holes is achieved. This has the advantage that the lubricant forms an even quasi-stationary cutting oil film on the functional surfaces of the shearing punch and inner form punch, cutting die and ejector, which leads to a further decrease of wear of the active elements of the tool.

Further advantages and details accrue from the following description with reference to the attached figures.

In the following, the invention will be explained in more detail at the example of two embodiments.

DETAILED DESCRIPTION OF THE INVENTION

Figure 1:
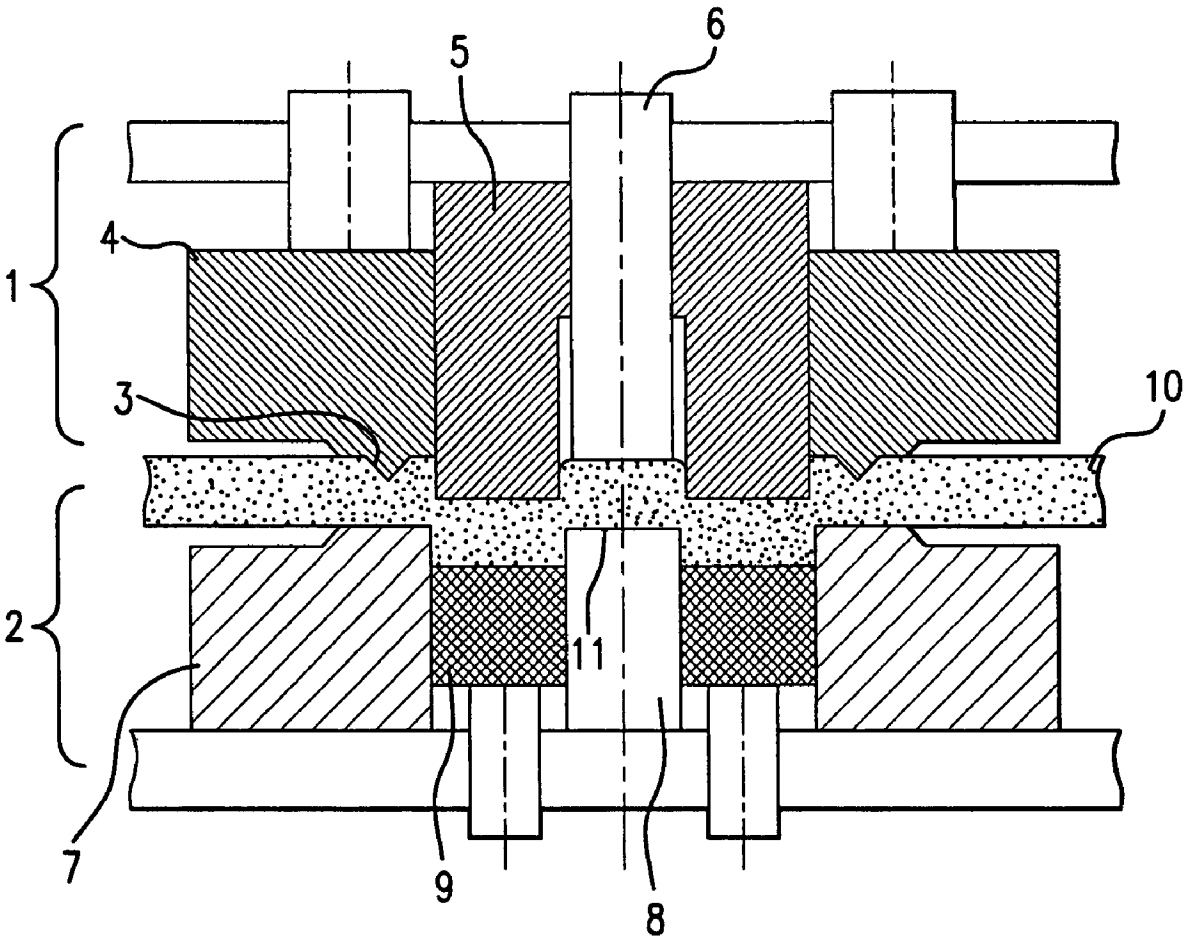
FIG. 1 is a schematic view of the principle structure of a fine blanking tool according to the state of the art.

FIG. 1 shows the principle structure of a fine blanking tool according to the state of the art in the closed state.

The fine blanking tool has an upper part 1 and a lower part 2. The upper part 1 of the fine blanking tool comprises a pressing pad 4 with a V-shaped projection 3, a shearing punch 5 guided in pressing pad 4 and an ejector 6. The lower part 2 consists of a cutting die 7, an inner form or hole punch 8 and an ejector 9. The strip 10, made of alloyed stainless steel with a thickness of 12 mm, from which, according to the method of this invention, shall be fabricated a fine blanked part 11, for example, a connecting flange from a steel strip, according to the shown state of the tool, is clamped between pressing pad 4 and cutting die 7 and the V-shaped projection 3 has already penetrated the strip 10, whereby the material, due to the applied force of the V-shaped projection, is prevented from continued flowing during cutting. The cutting die 7 and the inner form punch 8 have cut about half the material thickness of the fine blanking part.

The wear stress of shearing punch 5, V-shaped projection 3, cutting die 7 and inner form punch 8 is correspondingly high, so that sufficient lubrication of the friction places with cutting oil is necessary to carry out the fine blanking.

Figure 2:
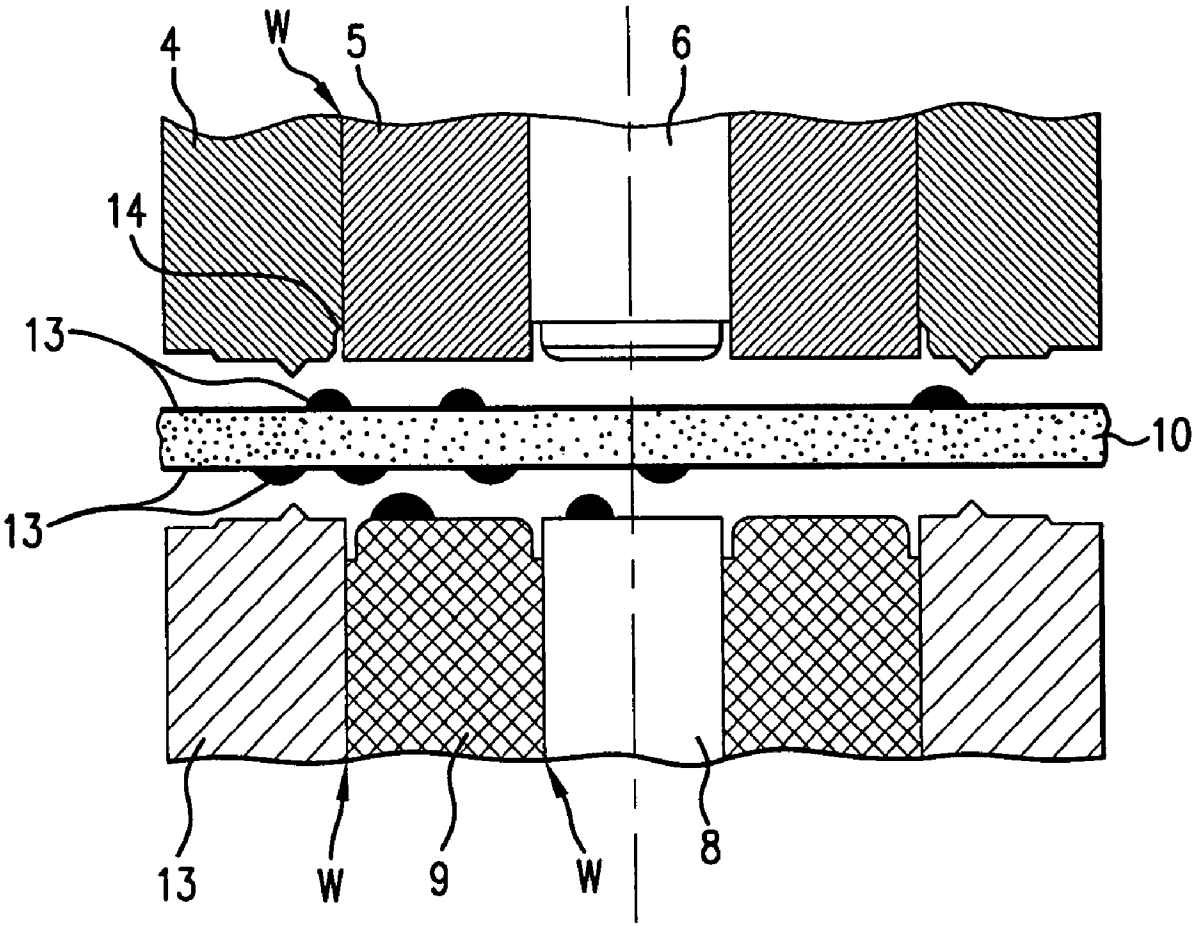
FIG. 2 is a schematic view of the lubrication in a fine blanking tool according to the state of the art.

FIG. 2 schematically shows the known, from the state of the art, measures to secure the lubrication of a fine blanking tool in the open state of the tool.

Basic precondition of the lubrication in the fine blanking tool is an even coating of the incoming strip with the cutting oil 13 when the tool is open. To secure an even coating or the existence of the oil coating of the strip, it is useful to check the oil and coating thickness at the incoming strip.

The very viscous cutting oil 13 comprises wetting agents and additives which, at high pressures and temperatures, occurring for example at the friction places in the fine blanking tool, form passivated layers with the active surfaces, working against the inclination to cold bonding.

When the tool closes, the strip 10 coated with cutting oil 13 on the upper and the lower sides is clamped between pressure pad 4 and cutting die 7. The pressure pad 4, the shearing punch 5 and the ejector 6 press on the upper side of strip 10 and the cutting die 7, the ejector 9 and the inner form punch 8 on the lower side of the strip, whereby the cutting oil 13 is pressed from the surfaces into the lubrication bore reliefs 14, which are formed by chamfers 15 at the pressure pad 4 and at the ejector 6 of the upper part 1 and by a chamfer 16 at the ejector 9 at the lower part 2 of the fine blanking tool. The cutting oil 13 pressed out from the surface of strip 10 collects in the lubrication bore reliefs 14 and can penetrate, as seen from the upper side of strip 10, along the effective gaps W formed between pressure pad 4 and shearing punch 5, as well as shearing punch 5 and ejector 6 into the workpiece and the functional surfaces 17 and 18, when the shearing punch 5 moves in the cutting direction, i.e., the convex surface of the shearing punch 5 and the guiding surface of the pressure pad 4 are accordingly lubricated. Lubrication of the tool from the lower side of the strip is realized by the oil, that has accumulated in the lubrication bore relief 14 arranged at ejector 9. The cutting oil is carried in the cutting direction, when the ejector 9 moves, and via effective gap W formed between cutting die 7 and ejector 9, and reaches the functional surfaces 19 and 20, i.e., on the one hand, the outer convex surface of the ejector 9 and the guiding surface of the cutting die 7 and on the other hand, the inner convex surface of the ejector 9 and the convex surface of the inner form punch 8.

It is well known that, at fine blanking, the inclination to cold bondings between shearing punch 5 and fine blanking part 11 increases with increasing thickness of the material. At a workpiece thickness of more than 10 mm fine blanking, in general, is no longer process secure, and gets increasingly uneconomical because of the unreasonable finishing expenditure. The reason of these disadvantages are found in the circumstance, that because of the high pressure the cutting oil is pressed out of the effective gaps and thus, despite all these known lubrication measures, a break off of the cutting oil flow can not be prevented with increasing thickness of parts.

Embodiment 1

Figure 3:
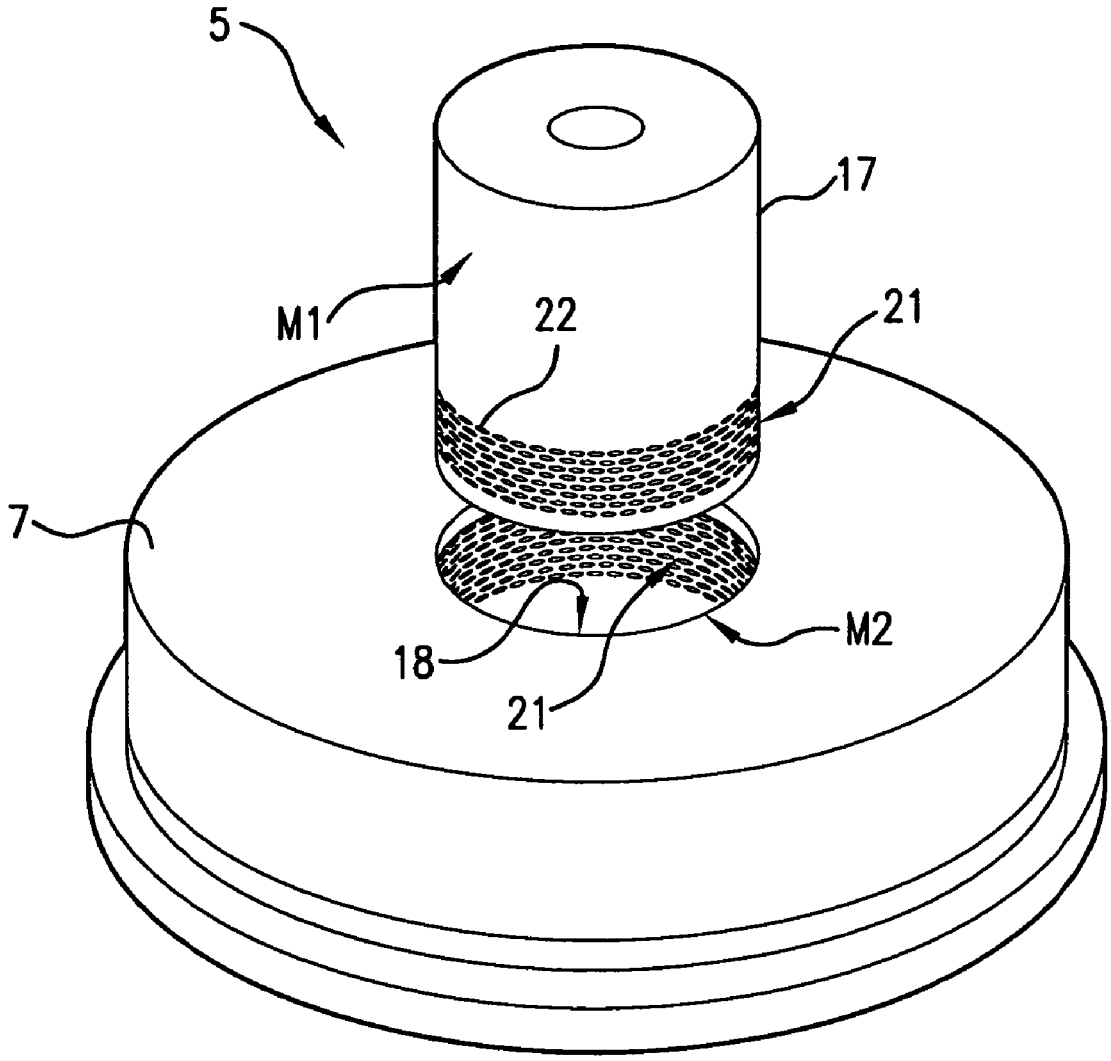
FIG. 3 is a perspective view of the micro-surface structure on the functional surfaces of the device according to this invention.

The device according to this invention in embodiment 1, in general, corresponds with the structure of the device which was described with reference to FIG. 1. FIG. 3 shows the micro-surface structure 21 according to this invention at the example of functional surfaces 17 and 18 of a shearing punch 5 and a cutting die 7. The convex surface M1 of shearing punch 5 and the concave surface M2 of cutting die 7 are polished and, for instance, coated with titanium carbonitride. A multitude of indentations 22 fabricated by means of laser beam machining or other suitable machining operations like grinding or milling or the like covers the convex and concave surfaces M1 and M2, respectively. The average depth of the indentations 22 is about 0.05 mm. The indentations 22 extend in horizontal rows with regular distances to each other, which are arranged perpendicular to the cutting direction SR. The functional surfaces 17 and 18 are regularly covered with these indentations.

Figure 4A:
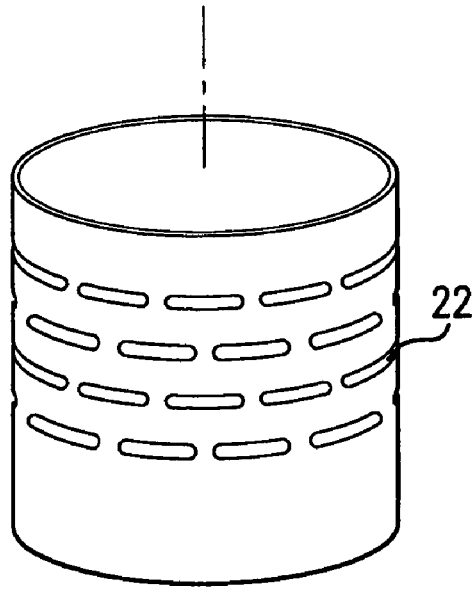
FIGS. 4*a*, 4*b* and 4*c* depict further variations of the micro-surface structure.
Figure 4B:
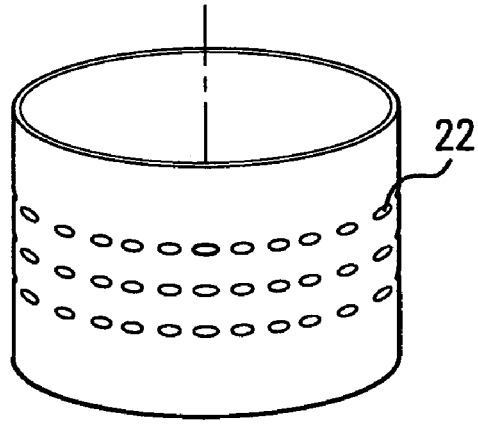
Figure 4C:
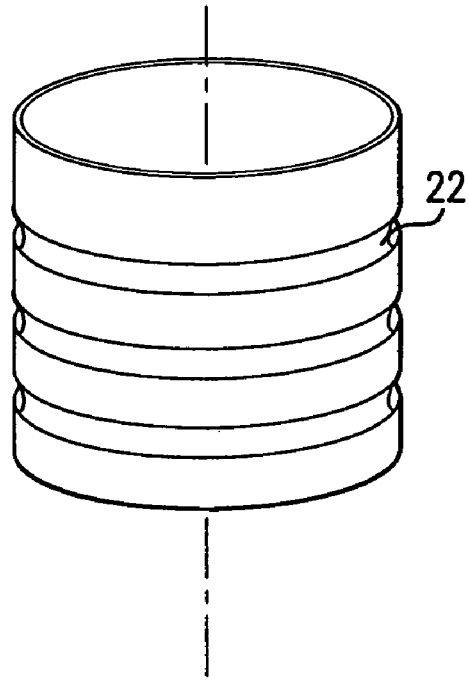

These indentations 22 can have a different geometry and shape. So for example, grooves, pits, slots of advantageously relatively elongated dimensions, or entirely circular grooves or even bore holes, can be placed in the functional surfaces. Within these constructs, it is desirable that rows of indentations 22, arranged above or beneath each other, do not have connections to each other which extend in the cutting direction. Examples of various indentations 22 are given in FIG. 4 (FIGS. 4*a*, 4*b* and 4*c*).

Figure 5B:
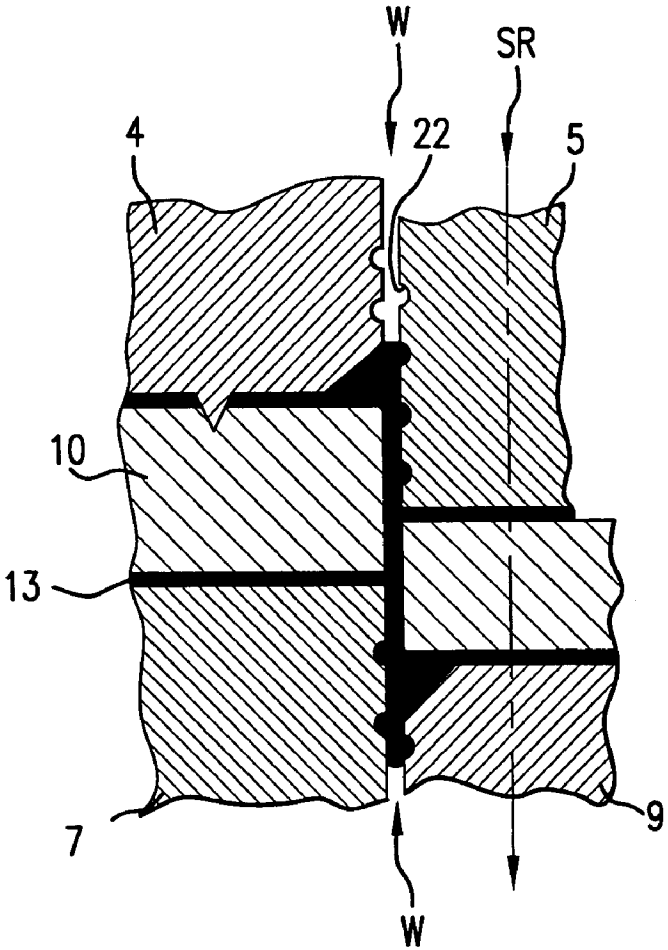
FIGS. 5*a* to 5*c* each is a schematic view of the execution of the method according to this invention in the effective gap according to this invention.
Figure 5A:
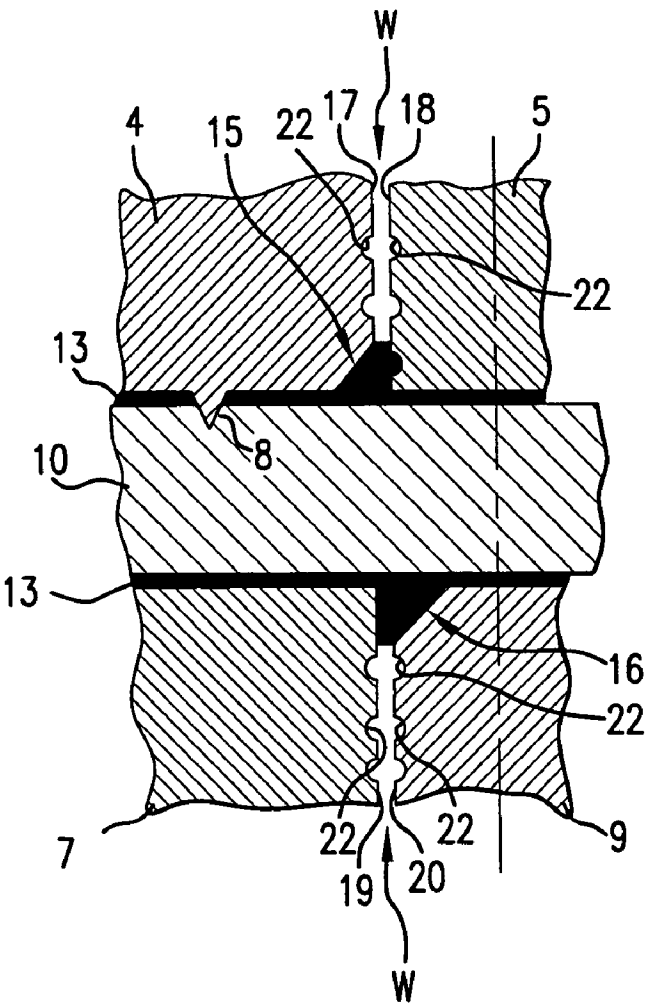
Figure 5C:
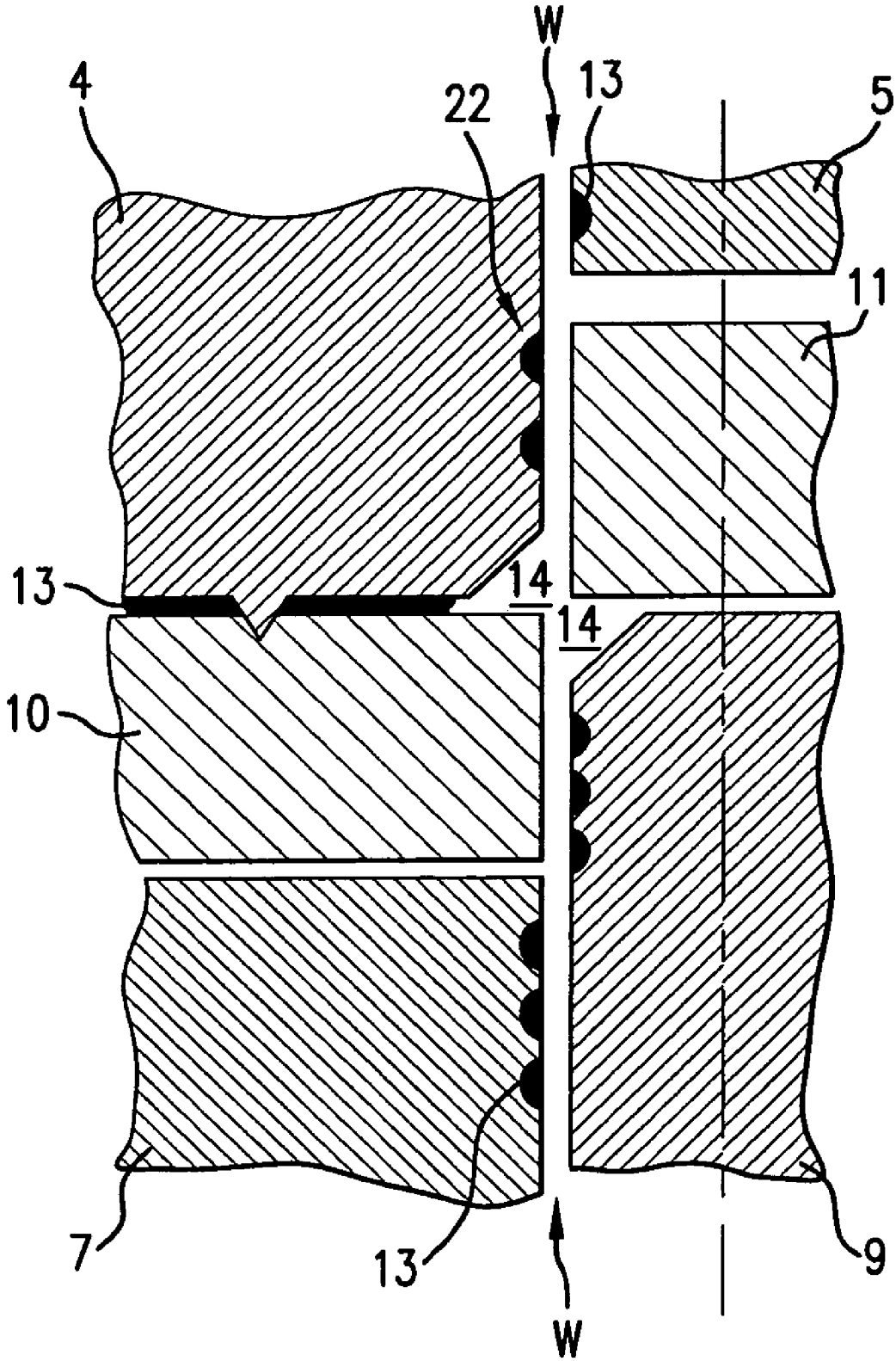

The sequence of the method according to this invention is described at the example of FIGS. 5*a* to 5*c*. In FIG. 5*a*, the strip 10 is clamped between pressure pad 4 and cutting die 7. The cutting oil 13 pressed from the upper side of strip 10 fills the lubrication bore reliefs 14 at the pressure pad 4 and the ejector 9. The indentations 22 formed into the functional surfaces 17 and 18 of shearing punch 5 and pressure pad 4 are not yet filled with cutting oil 13 from the lubrication bore reliefs 14.

As soon as the shearing punch 5 moves on in the cutting direction SR, the indentations 22 pass the lubrication bore relief 14, and a respective quantity of cutting oil is removed from the lubrication bore reliefs at the upper side of the workpiece due to the geometry and the shape of the surface structure of the convex surface of the shearing punch during its down movement in the cutting direction.

The indentations fill up with cutting oil 13 accumulated in lubrication bore relief 14, as illustrated in FIG. 5*b*, by a complete blackening of the concerned indentations 22. The removed and accumulated in the surface structure quantity of oil is carried on and is evenly distributed on the functional surfaces passing by each other, whereby a quasi-stationary cutting oil film is created on the functional surfaces 17 and 18.

Synchronous to the forward movement of the shearing punch 5, the ejector 9 moves in the cutting direction SR. Indentations 22 in the functional surface 20 of cutting die 7, along which the lubrication bore relief 14 filled with cutting oil from the lower side of the strip, passes the ejector 9 filled up with cutting oil. The accumulated in the surface structure quantity of cutting oil is also evenly distributed on the functional surfaces as quasi-stationary cutting oil film, when the functional surfaces 19 and 20 pass by.

The effective gaps W between pressure pad 4 and shearing punch 5, on the one hand, and cutting die 7 and ejector 9, on the other hand, are totally filled with cutting oil, so that cutting oil 13 from the lubrication bore relief can reach the active surfaces in the forming zone.

After fully cutting the strip 10, the shearing punch 5 and the ejector 9 move against the cutting direction SR. The functional surface 19 of the ejector passes the filled with oil indentations 22 in the functional surface 20 of the cutting die 7, and thus is respectively lubricated (see FIG. 5*c*). The indentations 22 in the respective functional surfaces 17 and 18 or 19 and 20 stay largely covered both in the cutting direction, and against the cutting direction, by the respective convex and concave surfaces of shearing punch 5 or pressing pad 4 or cutting die 7 or ejector 9, so that the oil accumulated in the indentations 22 of the micro-surface structure, despite the movement of shearing punch 5 and ejector 9, stays in the indentations 22 in a quasi-stationary manner.

The geometrically regular distribution of the indentations 22 on the functional surfaces 17 or 18 and 19 or 20 increases the effect of steadiness of the lubrication of the functional surfaces. The lubrication effect is further enhanced by the effect that the high temperature occurring in the friction places promotes the creation of a passivated layer due to the conversion of the additives like chlorine, phosphates or sulfonates, which in the last instance, decreases the inclination towards cold bondings, especially in the case of workpieces with a thickness of more than 10 mm.

By calculating the dimensions, i.e., the size of the chamfers 15 or 16 at the pressure pad 4 and at the ejector 9, the capacity of the lubrication bore reliefs 14 can be respectively changed. A greater thickness of the workpieces needs a greater quantity of cutting oil to be provided to the friction places, so that by choosing a bigger chamfer 15 or 16, the accumulated quantity of cutting oil in the lubrication bore relief 14 can be also increased.

The quantity of cutting oil that is transported into the forming zone by the shape, geometry and depth of the micro-surface structure can be determined, so that thicker workpieces can be fine blanked in a secure process.

To provide the necessary quantity of cutting oil for the lubrication according to this invention, it has turned out to be appropriate to control the thickness of the coating or the cutting oil quantity on the strip by means of an oil and coating thickness check before the strip gets into the fine blanking tool. This facilitates adjustment of the thickness of the cutting oil film on the workpiece in dependence on the thickness, the material and the geometry of the workpiece.

Embodiment 2

Figure 6:
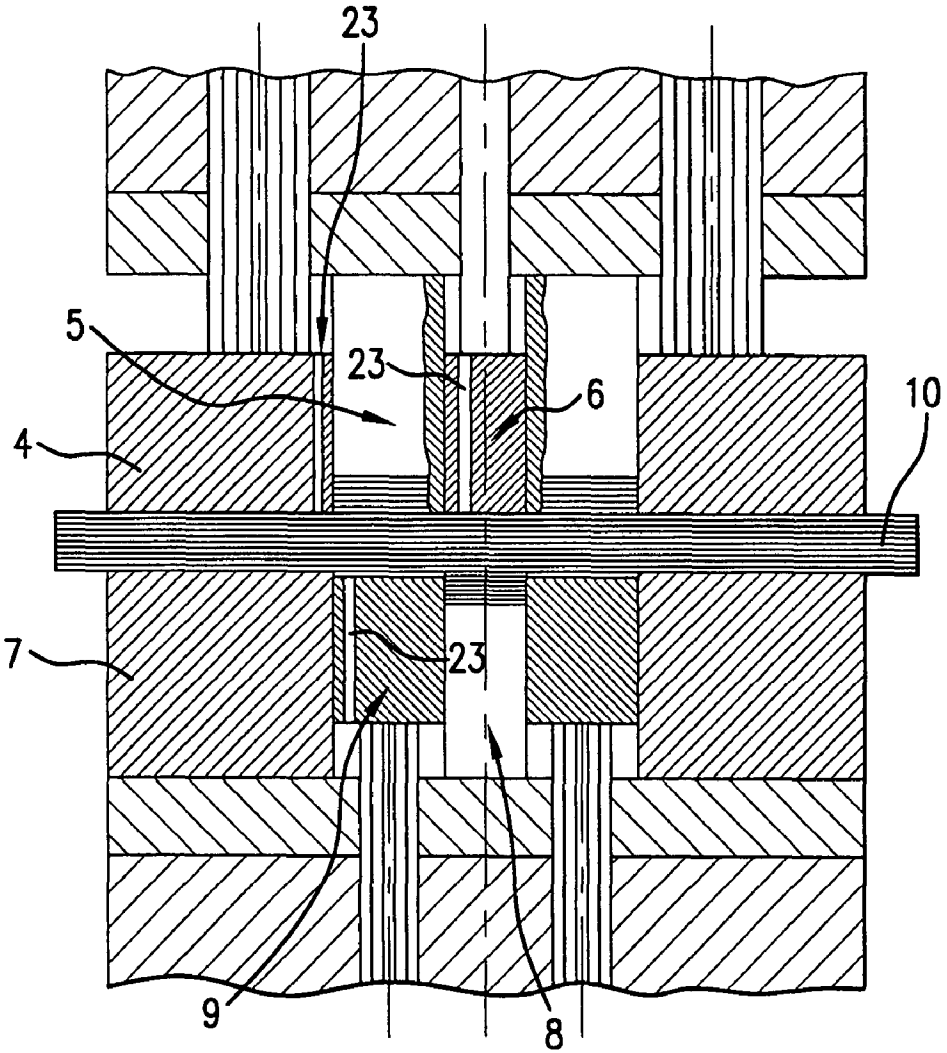
FIG. 6 is a cross-section through a further device with additional feeding of cutting oil according to this invention.
Figure 7:
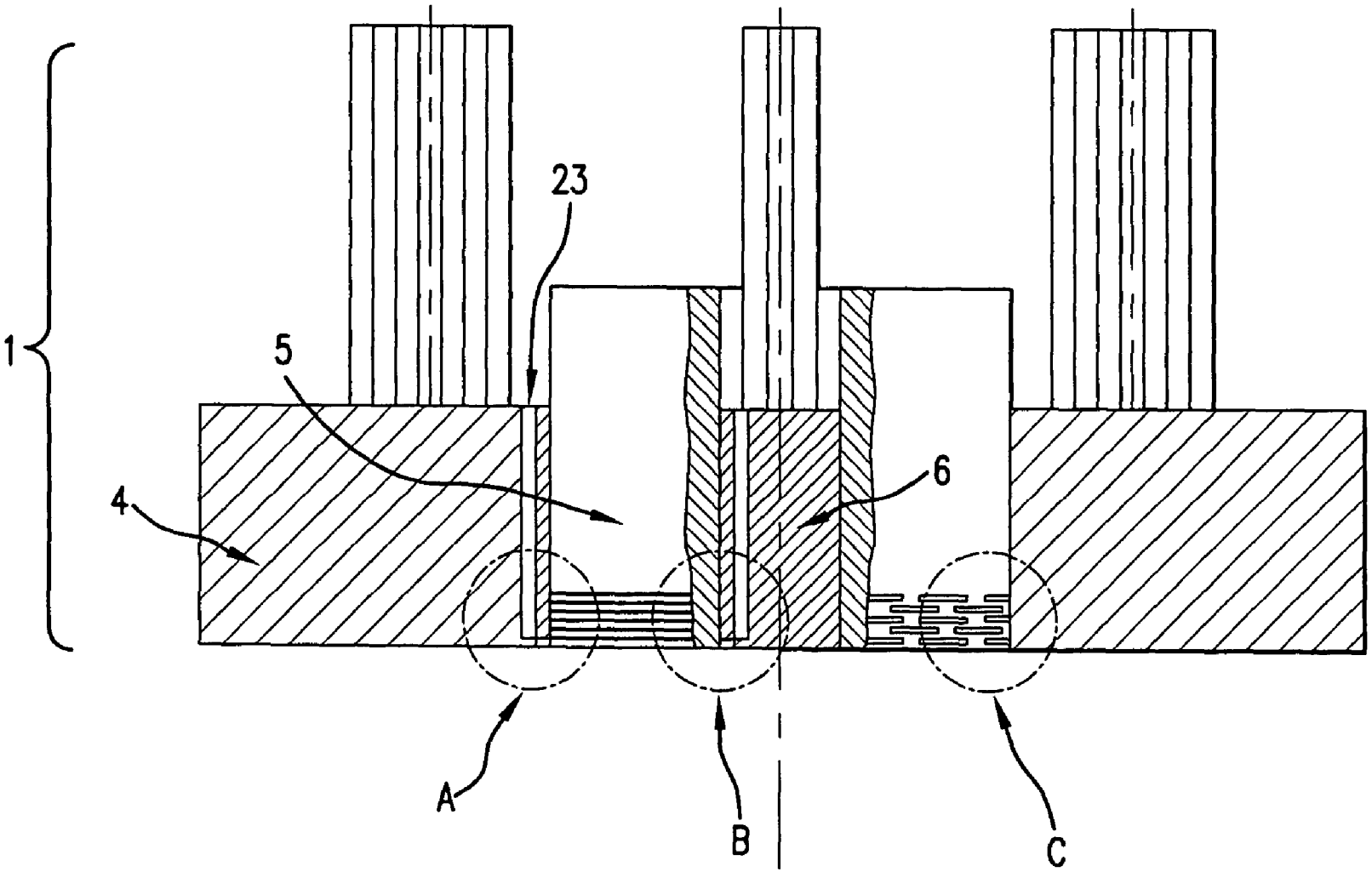
FIG. 7 is an enlarged view of the upper part of the device according to this invention.
Figure 8:
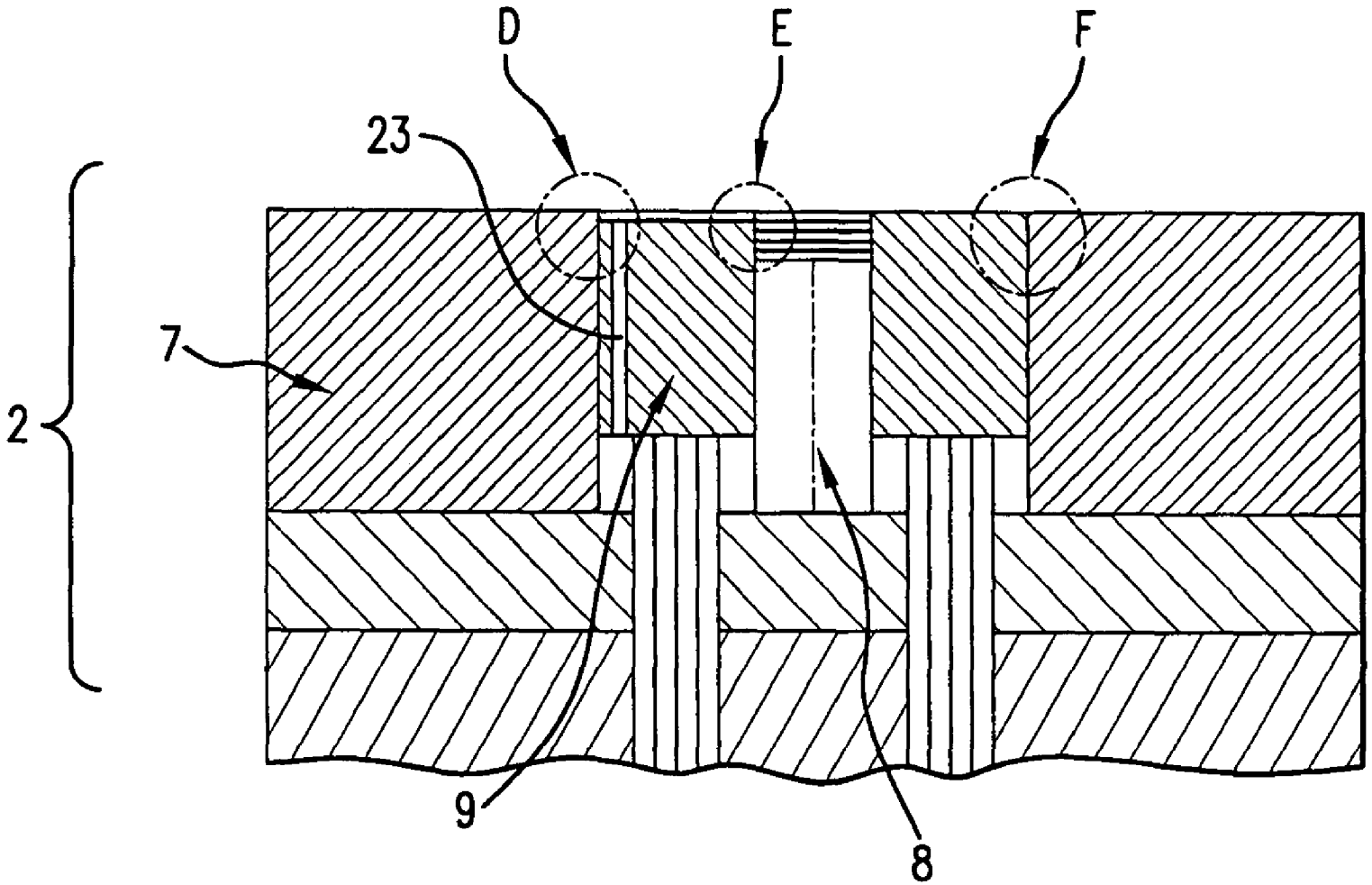
FIG. 8 is an enlarged view of the lower side of the device according to this invention.
Figure 9A:
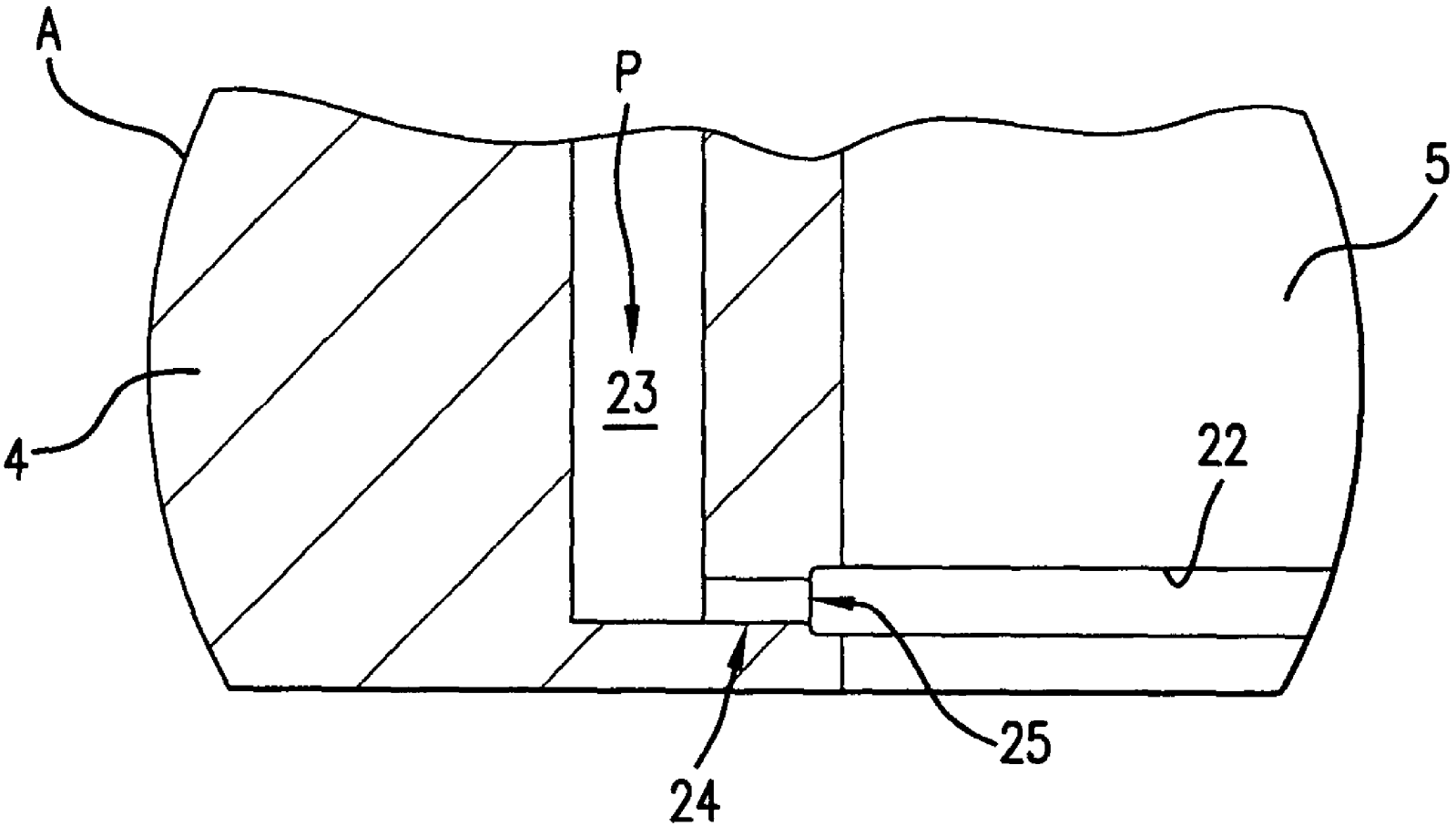
FIGS. 9*a*, 9*b* and 9*c* details A, B, and C of FIG. 7.
Figure 9B:
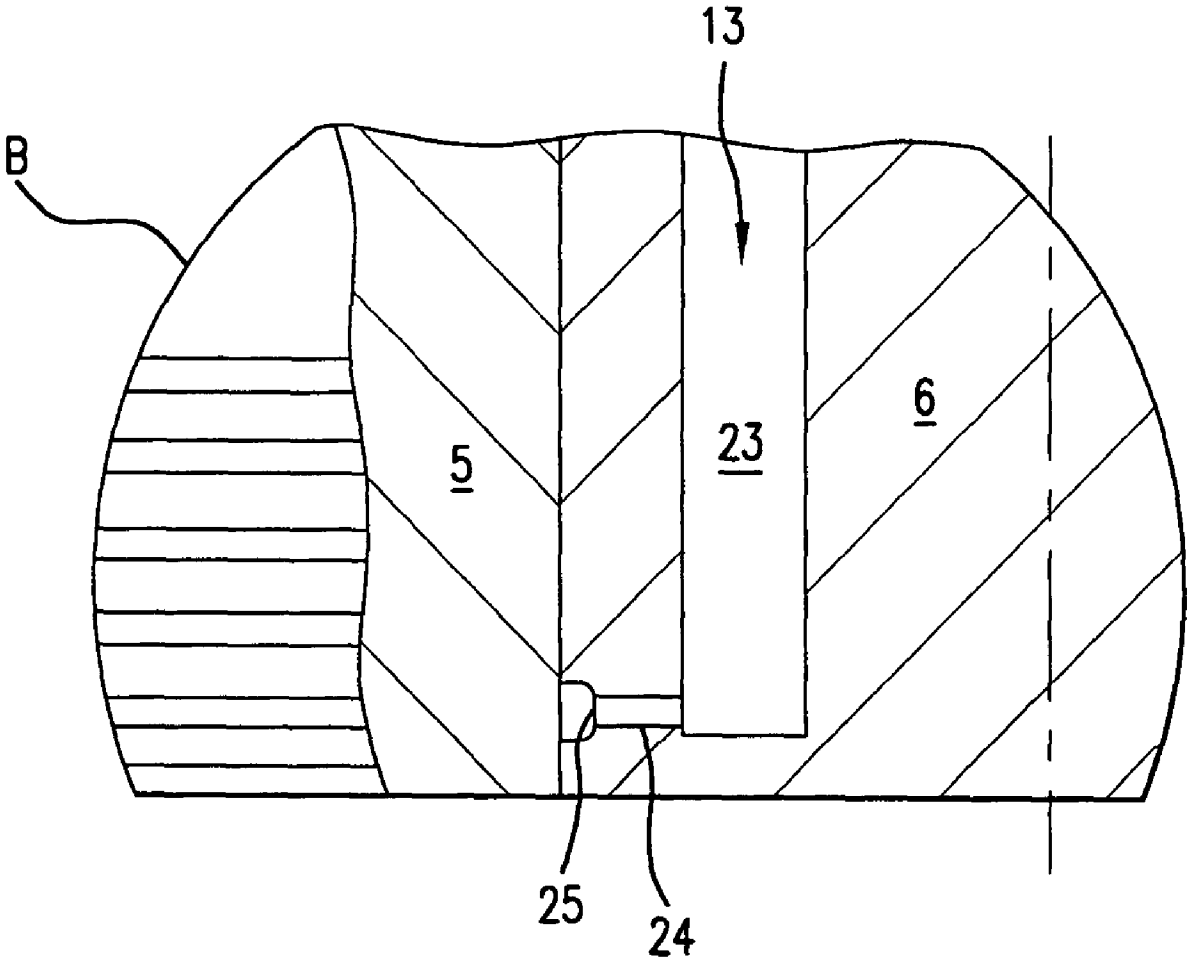
Figure 9C:
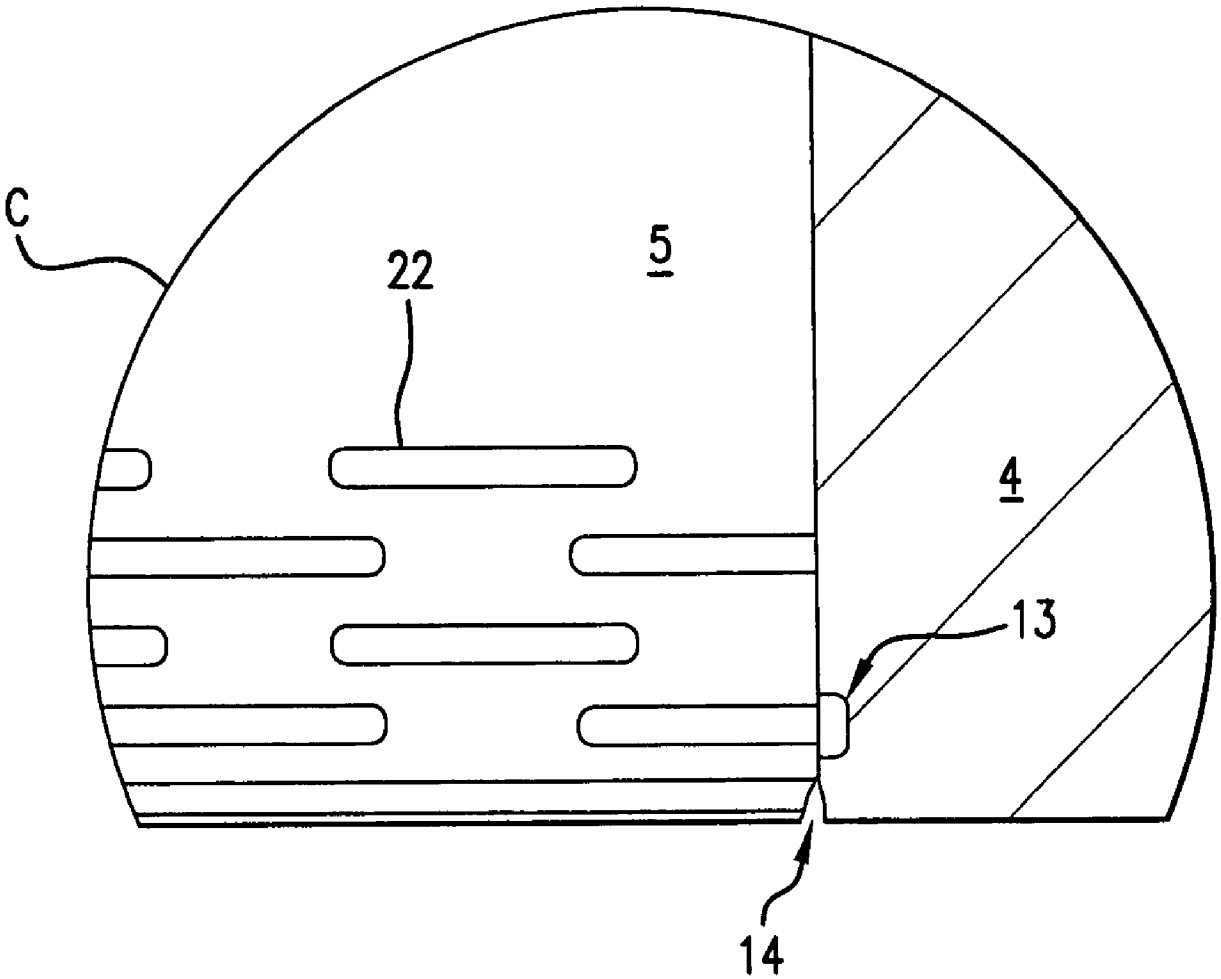
Figure 10A:
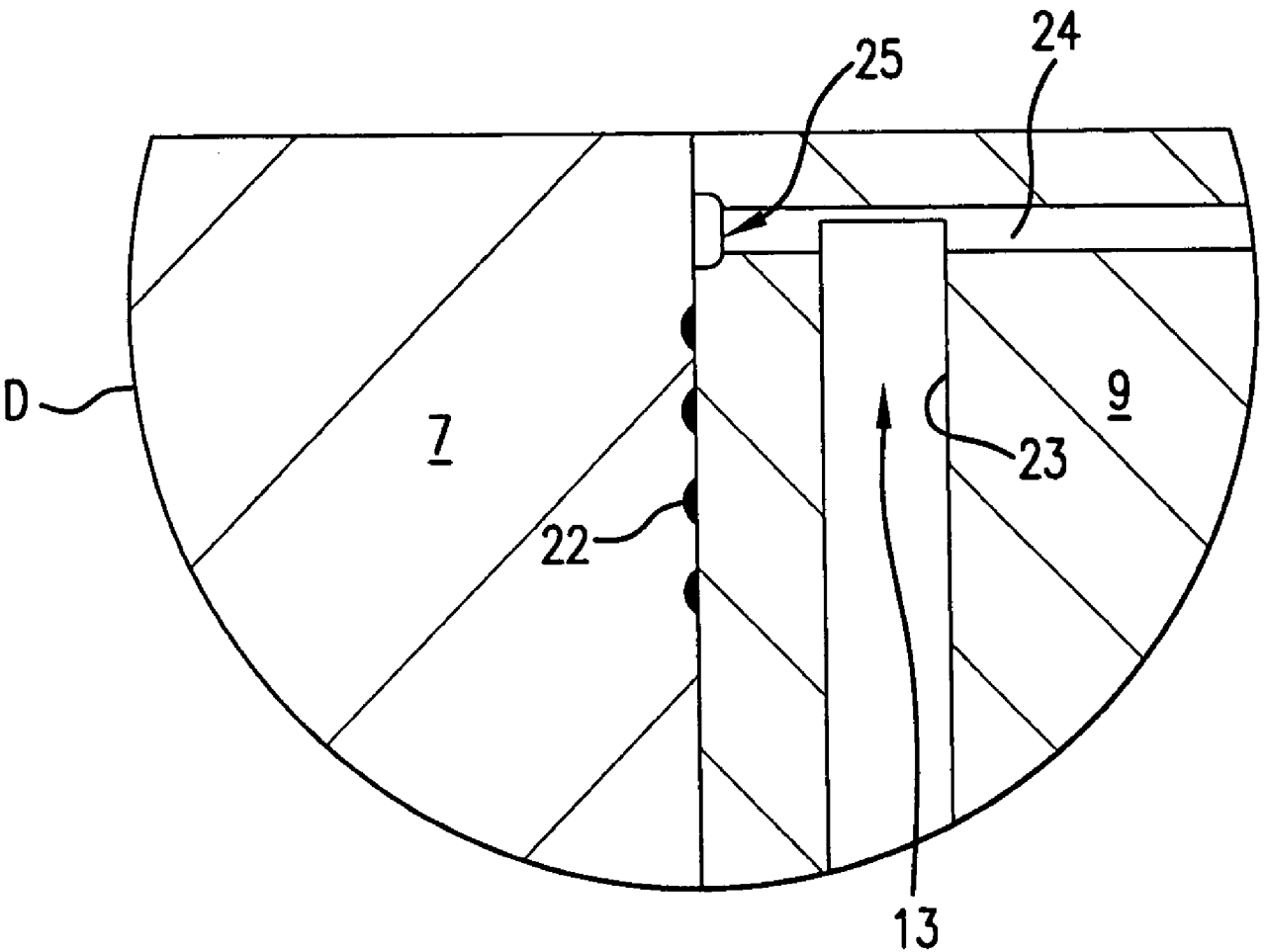
FIGS. 10*a*, 10*b* and 10*c* details D, E and F of FIG. 8.
Figure 10B:
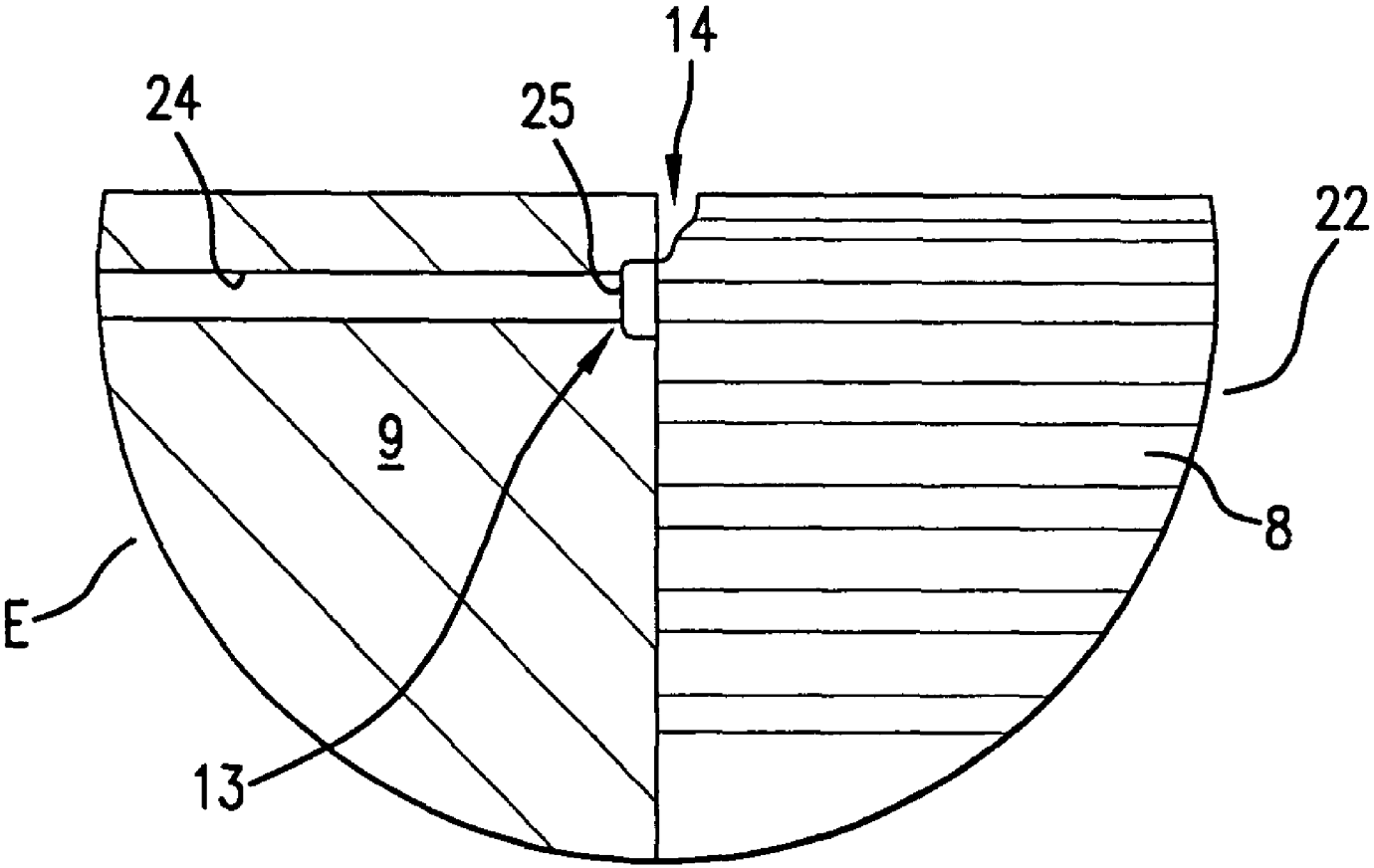
Figure 10C:
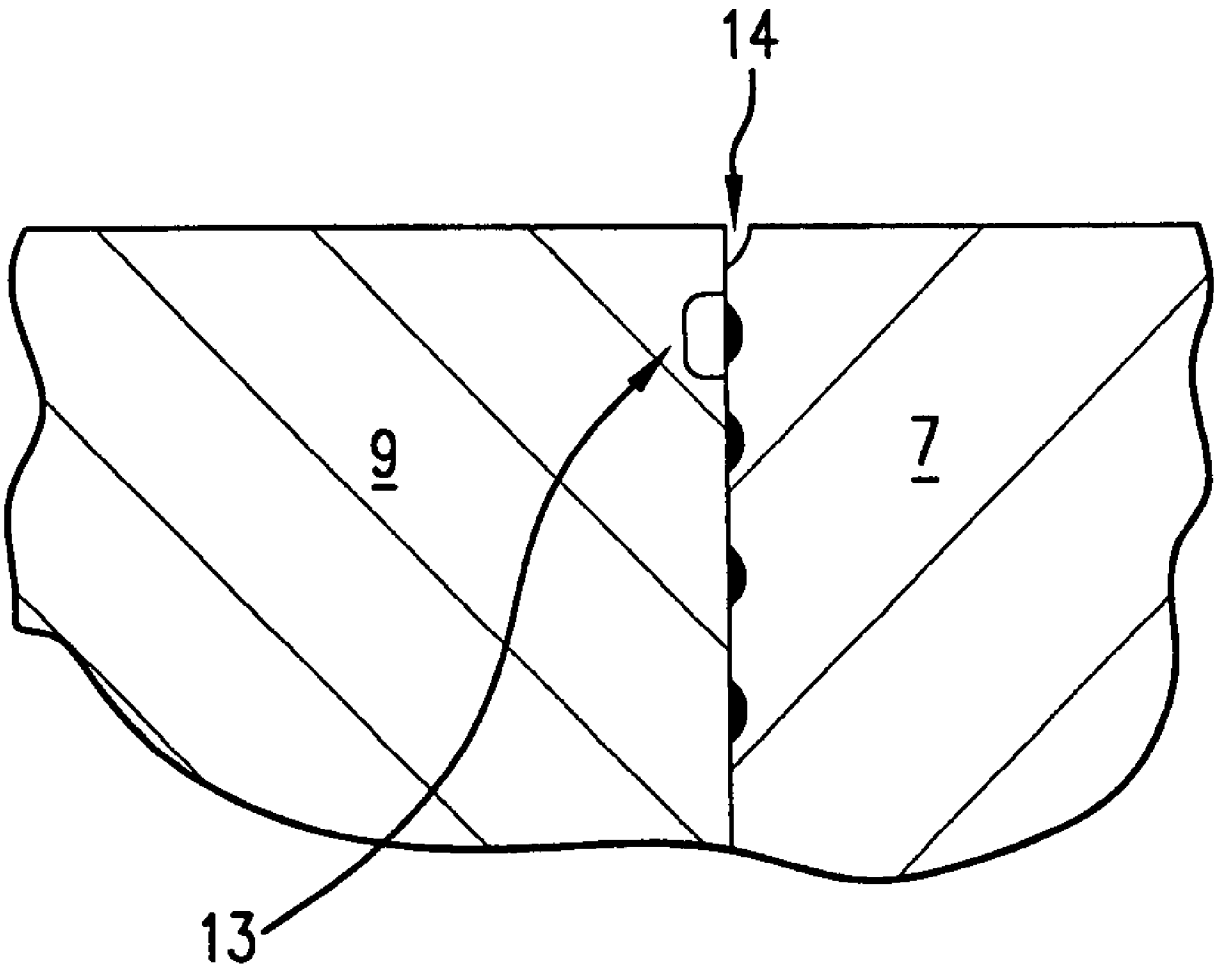

FIGS. 6 to 8 show a further variation of the device according to this invention that, in its principle structure, resembles the structure of the tool described in FIG. 1. In addition to the lubricating bore reliefs 14 at the pressure pad 4 and the ejector 9 the pressure pad 4, the ejector 9 and the ejector 6 respectively have a conduit 23 for providing additional cutting oil 13 via the effective gaps between pressure pad 4 an shearing punch 5, shearing punch 5 and ejector 6 and cutting die 7 and ejector 9 into the respective micro-surface structure. The conduit 23 is connected to a not shown feeding pipe for the connection to a pressure pump for delivering pressure for the cutting oil 13 to be provided. The conduit 23 exceeding in the pressure pad 4, in the ejectors 9 and 6 in the cutting direction SR, goes over to a section 24 exceeding perpendicular to the cutting direction with an opening 25 widening to the effective gap, through which can be provided cutting oil 13 under permanent pressure to the effective gaps.

In FIGS. 9*a* to 9*c* and 10*a* to 10*c*, are shown details of the delivery of cutting oil. It is clear that the opening 25 of the conduit 23 meets the indentations 22 near the cutting edge of the punch in the convex surface of the shearing punch 5, so that the cutting oil 13 being under pressure can totally fill the indentation 22. In the case of movement of the shearing punch 5 in the cutting direction SR, the above lying indentations 22 necessarily pass the opening 25 of conduit 23 and are also filled with cutting oil 13. The effective gap W between pressure pad 4 and shearing punch 5 is evenly filled with cutting oil 13 that is evenly distributed on the functional surface between pressure pad 4 and shearing punch 5, when the shearing punch 5 is moving. Via opening 25 of conduit 23 in ejector 9, the cutting oil 13 under pressure gets into the indentations 22 of cutting die 7. The effective gap W between cutting die 7 and ejector 9 is filled with cutting oil that is evenly distributed onto the functional surfaces 19 and 20 when the ejector 9 is moving. Via effective gap W, the cutting oil 13 reaches the active surfaces in the forming zone, i.e. the place where the shearing punch cuts the workpiece.

The invention claimed is:

1. A method of lubricating a tool and a workpiece at cutting and forming, from a flat strip, comprising:

wetting a surface of the flat strip with a cutting oil film;

clamping the flat strip between an upper part comprising a shearing punch, a pressure pad for the shearing punch, a V-shaped projection positioned on the pressure pad and an upper ejector, and a lower part comprising a cutting die, a lower ejector and an inner form punch;

pressing out cutting oil from the cutting oil film by operation of the pressure pad, the shearing punch, the upper ejector, the cutting die, the lower ejector and the inner form punch so as to force the cutting oil into chamfers at the pressure pad and into lubrication bore reliefs in the ejector in which the cutting oil is temporarily stored as a stocked up cutting oil;

accumulating a quantity of accumulated cutting oil from the stocked up cutting oil in a micro-surface structure of each of respective functional surfaces of the shearing punch and the cutting die;

evenly distributing on the functional surfaces a quasi-stationary cutting oil film formed from the quantity of accumulated cutting oil and resulting from movement of the functional surfaces past each other during cutting of the workpiece; and providing said quantity of accumulated cutting oil, via respective effective gaps between the pressure pad and the shearing punch and between the cutting die and the lower ejector, to active surfaces of the shearing punch and the workpiece in a forming zone of the workpiece.

2. A method according to claim 1, further comprising adjusting the quantity of accumulated cutting oil in the lubrication bore reliefs relative to dimensioning of the chamfer at the pressure die and a chamfer at the lower ejector, said dimensioning being determined according to a workpiece thickness and geometry.

3. A method according to claim 1, further comprising adjusting a layer thickness of the cutting oil film on the workpiece by adjusting the amount of cutting oil and an oil layer thickness relative to a thickness of the workpiece, material of the workpiece and a workpiece geometry.

4. A method according to claim 1, wherein said quantity of cutting oil provided to the forming zone is determined by a geometry and a depth of the micro-surface structure.

5. A method according to claim 1, wherein the micro-surface structure of the functional surfaces of the shearing punch and the cutting die and a micro-surface structure of a functional surface of the inner form punch are fabricated by laser beam, grinding or milling machining.

6. A method according to claim 5, wherein respective convex and concave surfaces of the shearing and the inner form punches, and a guiding surface of the cutting die, comprise the functional surfaces.

7. A method according to claim 1, comprising:

a) shearing off and removing a sheared off quantity of cutting oil from the lubrication bore reliefs on an upper side of the workpiece due to a geometry of a surface structure of a convex surface of the shearing punch during downward movement thereof in a cutting direction, b) carrying on the sheared off quantity of cutting oil from the micro-surface structure of the convex surface of the shearing punch according to operation a) as a carried on quantity of oil and distributing the carried on quantity of oil as the quasi-stationary cutting oil film up to the cutting or forming zone of the workpiece, c) shearing off and removing a quantity of cutting oil from the lubrication bore reliefs on a lower side of the workpiece due to a surface structure of a convex surface of the lower ejector; and d) carrying on the sheared off quantity of cutting oil from a surface structure of the convex surface of the lower ejector and distributing the carried on quantity of oil on a surface structure of a guiding surface of the cutting die when the convex surface of the lower ejector passes the guiding surface of the cutting die against the cutting direction.

8. A method according to claim 1, wherein the flat strip comprises steel or aluminum.

9. A method according to claim 1, wherein the cutting oil is mixed with at least one of phosphates, sulfonates or chlorine high viscous lubrication oil.

10. A method of lubricating a tool and a workpiece at cutting and forming, comprising:

clamping a flat strip wetted on the surface with a cutting oil film at closing between an upper part comprising a shearing punch, a pressure pad for the shearing punch, a V-shaped projection positioned on the pressure pad and an upper ejector and a lower part consisting of a cutting die, a lower ejector and an inner form punch;

supplying a first quantity of cutting oil from the cutting oil film to effective gaps respectively present between the shearing punch and the pressure pad, the cutting die and the lower ejector, and the shearing punch and the inner form punch;

permanently providing the effective gaps with a second quantity of cutting oil under controllable pressure via a conduit extending in the shearing punch, the upper and the lower ejector and the inner form punch;

accumulating a first quantity of said second quantity of cutting oil in a micro-surface structure of functional surfaces of the shearing punch and the cutting die and evenly distributing the first quantity of said second quantity of cutting oil on the functional surfaces of the shearing punch and the pressure pad, the upper ejector and the cutting die and the lower ejector and the inner form punch as a quasi-stationary cutting oil film throughout movement of the functional surfaces past each other; and providing a second quantity of said second quantity of cutting oil via the respective effective gaps to active surfaces of the shearing punch and the workpiece in the forming zone.

11. A method according to claim 10, wherein the second quantity of cutting oil is controlled by a pump in accordance with a thickness of the workpiece.

12. A device for lubricating a tool and a workpiece at cutting and forming, comprising:

a tool comprised of two parts including at least one shearing punch, a pressure pad for the shearing punch, a V-shaped projection positioned on the pressure pad, an upper ejector, a cutting die, a lower ejector and an inner form punch;

a flat strip, wetted on both sides with a cutting oil film, being clampable between the pressure pad and the cutting die, chamfers being positioned at the pressure pad and the upper ejector and at the cutting die and the lower ejector forming lubrication bore reliefs for collecting cutting oil from the film formed on the upper and lower sides of the workpiece, effective gaps being present between the shearing punch and the pressure pad, the cutting die and the lower ejector and the shearing punch and the inner form punch to supply the cutting oil to a forming zone of the workpiece; and at least the shearing punch and the cutting die including a micro-surface structure on functional surfaces thereof arranged perpendicularly to a cutting direction and regularly distributed over the functional surfaces for receiving and evenly distributing cutting oil in a quasi-stationary layer thickness via the effective gaps up to the forming zone of the workpiece.

13. A device according to claim 12, wherein the lower ejector includes a micro-surface structure on a functional surface thereof.

14. A device according to claim 12, wherein convex surfaces of the shearing punch and the lower ejector are provided as the functional surfaces.

15. A device according to claim 12, wherein guiding surfaces of the pressure pad and the cutting die are provided as the functional surfaces.

16. A device according to claim 12, wherein the functional surfaces of the shearing punch, the ejector, the pressure pad and the cutting die are polished and/or coated.

17. A device according to claim 12, wherein the micro-surface structure is formed of at least one of separate and discrete groove-shaped indentations, elongated pits or bore holes, which cover at least a part of the functional surfaces.

18. A device according to claim 17, wherein the surfaces of the indentations, the elongated pits or the bore holes are polished and coated.

19. A device according to claim 17, wherein the indentations, elongated pits or bore holes are arranged in a regular pattern which is formed above or beneath each other so as to be arranged as non-vertically aligned, horizontal rows of indentations, elongated pits or bore holes so that respective ones of the rows are staggered relative to each other.

20. A device according to claim 17, wherein the indentations and/or or the elongated pits of different rows overlap each other.

21. A device according to claim 17, wherein the indentations, the pits or the bore holes have a depth of 0.03 to 0.05 mm.

22. A device according to claim 12, wherein the size of the chamfers at the pressure pad and the upper and lower ejectors is dimensioned according to a thickness of the workpiece.

23. A device for lubricating a tool and a workpiece at cutting and forming, comprising:

a tool including two parts including at least one shearing punch, a pressure pad for the shearing punch, a V-shaped projection positioned on the pressure pad, an upper ejector, a cutting die, a lower ejector and an inner form punch;

a flat strip, wetted on both sides with a cutting oil film, being clampable between the pressure pad and the cutting die, effective gaps being provided between the shearing punch and the pressure pad, the cutting die and the lower ejector and the shearing punch and the inner form punch to supply a cutting oil to a forming zone of the workpiece, a conduit arranged in the pressure pad and in the upper ejector and the lower ejector including an outlet opening for providing a controlled supply of cutting oil into effective gaps present between the shearing punch and the pressure pad, the cutting die and the lower ejector and the shearing punch and the inner form punch; and a micro-surface structure on functional surfaces of the lubricating tool arranged perpendicularly to a cutting direction and regularly distributed over the functional surfaces for receiving and evenly distributing cutting oil in a quasi-stationary layer thickness via the effective gaps up to the forming zone.

24. A device according to claim 23, wherein the conduit is connected to a cutting oil reservoir held under pressure.

* * * * *